United States Patent [19]

Schmidt

[11] Patent Number: 4,522,509

[45] Date of Patent: Jun. 11, 1985

[54] CLOCKWORK RETAINING ASSEMBLY

[75] Inventor: Karl W. Schmidt, Idar-Oberstein, Fed. Rep. of Germany

[73] Assignee: Gebrüder Schmidt GMBH & Co. KG, Idar-Oberstein, Fed. Rep. of Germany

[21] Appl. No.: 506,712

[22] Filed: Jun. 22, 1983

[30] Foreign Application Priority Data

Dec. 4, 1982 [DE] Fed. Rep. of Germany ..... 3244918

[51] Int. Cl.[3] ..... G04B 37/00

[52] U.S. Cl. ..... 368/300

[58] Field of Search ..... 368/76, 80, 88, 276, 368/299–300, 316–318

[56] References Cited

U.S. PATENT DOCUMENTS

| | | | |
|---|---|---|---|
| 1,721,651 | 7/1929 | Wadsworth | 368/300 |
| 3,520,130 | 7/1970 | Oltramare | 368/300 |
| 3,979,900 | 9/1976 | Dorflinger et al. | 368/88 |
| 4,316,277 | 2/1982 | Endo | 368/76 |

FOREIGN PATENT DOCUMENTS

| | | | |
|---|---|---|---|
| R 9318 | 3/1956 | Fed. Rep. of Germany | 368/300 |
| 1503081 | 11/1967 | France | 368/300 |
| 312594 | 3/1956 | Switzerland | 368/300 |

*Primary Examiner*—Vit W. Miska

*Attorney, Agent, or Firm*—Karl F. Ross; Herbert Dubno

[57] ABSTRACT

A clockwork is held in a carrier which can form part of a clock housing or casing by a retaining bar which is pivotally connected at one end of the carrier, has a rectilinear portion spanning the clockwork and braced thereagainst and an opposite end which engages under an overhang at the opposite side of the carrier.

10 Claims, 5 Drawing Figures

CLOCKWORK RETAINING ASSEMBLY

CROSS REFERENCE TO RELATED APPLICATION

This application is related to my concurrently filed copending application Ser. No. 506,680 describing and claiming a wall-fastening system for a clock housing.

FIELD OF THE INVENTION

My present invention relates to a clockwork retaining system and, more particularly, to an arrangement in a clock housing or casing for retaining the timing mechanism, hereinafter referred to as a clockwork, therein.

BACKGROUND OF THE INVENTION

A clock can comprise a housing or casing, a face or bezel provided with a window and displaying the time-face over which the hands of the clock course in their circular orbits, a clockwork which may be a mechanism powered by an electric motor or a spring motor for driving the hands and, if desired, a removable back affording access to the clockwork.

In the aforementioned copending application, I have described systems for mounting the bezel or window-carrying wall of the clock and the rear wall of the housing or casing.

However, apart from affording access to the clockwork by removal of the front wall or rear wall in the event repair is necessary, it is desirable to provide a mounting or fastening system for the clockwork itself which can permit the clockwork to be removed from the casing in the event repair is necessary and to permit the casing to be easily secured in place for replacement or original assembly.

Conventionally the mounting of the clockwork is effected by means of screws or simply by holding the clockwork in place via a spring-fitted cover or a spring-fitted lens or window.

The first approach has been found to involve problems especially when the casing is die-cast from metal or injection molded from synthetic resin. When the casing or housing is fabricated by a die-casting process from metal, the internally threaded bores which must be provided to receive the mounting screws must be machined in a separate operation which is time-consuming and expensive and which creates problems with respect to tolerances as will be discussed briefly below.

When a screw-mounting system is utilized with injection-molded plastic articles, the screw-receiving bore must be provided with a threaded metal bushing injection-molded in place. This also represents a time-consuming fabrication technique and one which is sensitive to tolerance problems. When attempts are made to utilize self-tapping screws, there is always the danger that the screw may be overdriven and strip. This of course would make the entire casing useless. Sudden shocks or jolts tend to tear the small self-tap screws from the housing as well. The tolerance problems derive from the fact that the dimensions of the casing, when formed by die-casting or injection-molding, are sensitive to such factors as varying temperatures of the mold or die and of the flowable material reaching it, variations in composition of the material, variations in cooling conditions and fluctuating rates of injection of the flowable material.

Systems which use a spring-loaded backwall or a spring-loaded window or window-carrying wall to resiliently hold the clockwork in place are also fraught with problems because such retainers are generally incapable of holding the clockwork against the jolts and impacts to which clocks are frequently subject, especially if they are small enough to be used as traveling clocks.

OBJECTS OF THE INVENTION

It is the principal object of the present invention to provide an improved retaining system for the clockwork in a clock housing or casing which eliminates the need for screws or spring-loaded windows or backs of the clock and which, comparatively inexpensively and reliably is capable of holding the clockwork in a housing or casing and especially is capable of resisting jolts and impacts of the type described above.

Still another object of this invention is to provide an improved retainer assembly for the purposes described which will enable rapid removal and replacement of the clockwork and even rapid assembly of the clockwork into the casing during fabrication.

Still another object of this invention is to provide an improved retaining assembly for a clockwork in a clock housing or casing which will obviate the drawbacks enumerated above and others which have hitherto created problems in this art.

SUMMARY OF THE INVENTION

These objects and others which will become apparent hereinafter are attained in accordance with the invention, in a retaining system for a clockwork in a clock casing, housing or clockwork carrier which comprises one or more spring retainers in the form of rods engaging opposite sides of the housing and bearing along a rectilinear portion between the engaging forms, against the clockwork to hold the latter in place.

The spring rod, according to the invention, is thus provided with formations at its opposite ends which are offset from the rectilinear or substantially rectilinear portion and which bear against the clockwork to hold the latter against one of the walls, i.e. the front wall or back wall thereof while the other wall, i.e. the wall through which the retaining elements are exposed, can be removably attached to the casing or housing by the means described in the aforementioned copending application. The spring force of the holding element or elements thus effectively fixes the clockwork in the housing or casing. To prevent lateral shifting of the clockwork in the housing or casing, the wall against which the clockwork is pressed can be formed with a recess or ledge into which a complementary projection or against which a complementary surface can engage.

According to an embodiment of the invention, the spring wire retainer is pivotally engaged at one side of the casing and the other side of the casing and the retainers are formed with interlocking means enabling this latter end of the retainer to be engaged and releasably locked at this other side of the casing.

According to another feature of the invention, the clockwork itself comprises a box-like housing and fits into a recess of a wall of the casing or clockwork carrier. This recess is suitably shaped to receive the clockwork and this wall or the opposite wall of the casing can be provided with a window opening for receiving a glass or other lens structure through which the clock face can be displaced and one or more bores affording access to the clockwork, e.g. for passing the shafts to be connected to the hands and/or for passing winding or setting shafts. On the side wall of the casing, preferably near the two corners thereof, two swingable spring-retaining elements are pivotally mounted so that after the clockwork is inserted, these elements can be spanned over the clockwork and at the other end locked into an "L"-shaped or otherwise angled slit in the opposite side wall of the casing.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
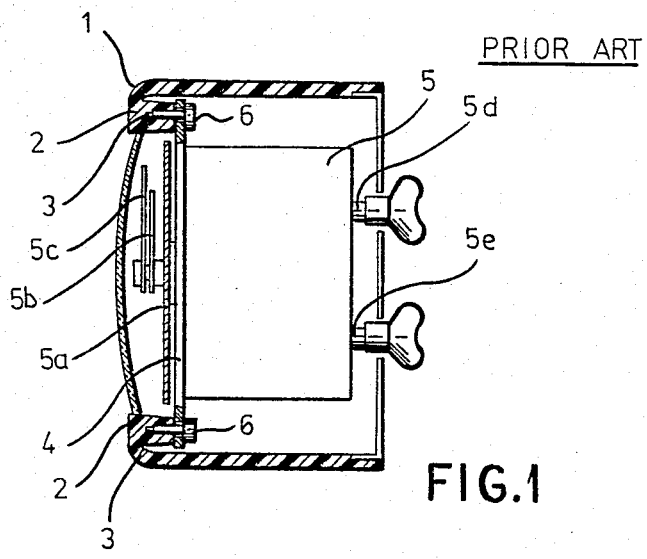
FIG. 1 is a vertical section through a clock casing illustrating a prior art arrangement in which the clockwork is connected by screws to the synthetic resin or plastics casing.
Figure 2:
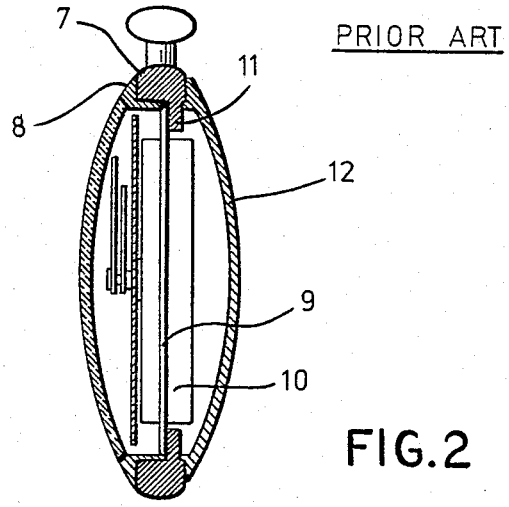
FIG. 2 shows a pocket watch in which the clockworks are held resiliently between two walls (prior art)

In FIGS. 1 and 2, I have shown the prior art mounting systems for respective clockworks 5 and 10 so that the problems associated with these prior art structures can be more fully appreciated.

In the winding clock of FIG. 1, the housing or casing 1 is composed of injection-molded synthetic resin and is provided at its front wall with a plurality of posts 2 which are formed with bores 3 in which small self-tapping screws 6 can hold the clockwork 5. Since the self-tapping screws form their threads directly in the synthetic resin material, even the slightest overturning of a screw can result in stripping of the thread and the ruination of the housing. In this figure, however, the clockwork 5 has been shown to carry the clock face 5*a*, an hour hand 5*b* and a minute hand 5*c*, as well as wind-up shafts 5*d* and 5*e* for the mechanical clock motor and the alarm motor. The shafts for setting the hands and setting an alarm have not been illustrated but are conventional and run through the rear wall of the housing as well. Similar structures can, of course, be applied to the clockworks to be described below even though they may not have been illustrated.

In the prior art pocket watch of FIG. 2, the central housing 7, at the face side, is provided with a lens 8 which springs into its seat in the housing 7 and bears upon an outer flange of the clockwork 10 on one side. Simultaneously, a rear wall 12 engages the housing 7 by spring action and the housing 7 is provided with a shoulder 11 against which the clockwork is retained. In this system, a sharp jolt of the casing can result in loosening of the engagement of the lens and hence can result in movement of the clockwork.

Figure 3:
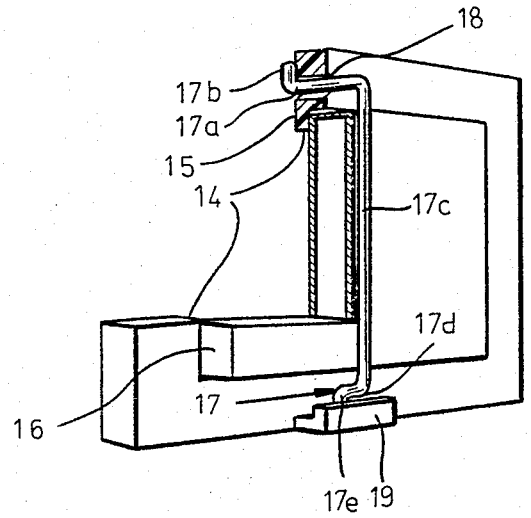
FIG. 3 is a partial perspective sectional view illustrating the principles of the invention according to one embodiment thereof.
Figure 5:
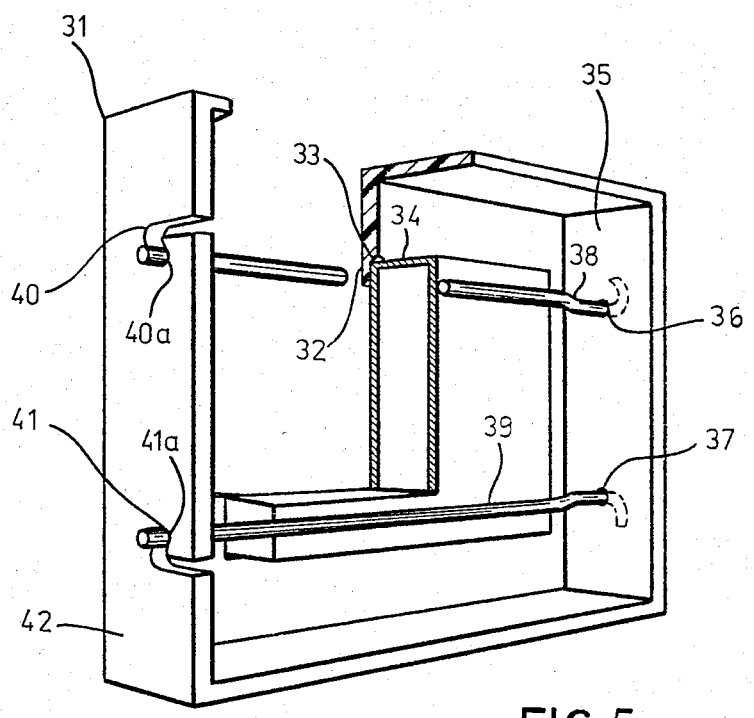
FIG. 5 is another perspective view, partly broken away, showing the mounting of a clockwork in a box-like casing according to the invention.

The terms of the invention illustrated by way of example in FIGS. 3 and 5, of course eliminate these drawbacks. In FIG. 3, the housing, casing or clockworks carrier is shown to comprise a flat body 13 which is formed with a cutout or recess 14 provided with a step 15 complementary to and receiving the clockwork 16. The latter is presented only as a shell but will be understood to contain the gearing, escapements, shafts, balance wheels, electric or spring motors and the like necessary for driving the hands in front of the clock face, none of which has been illustrated since all are conventional in the art.

The single spring retainer 17 is here a rod having a bent end 17*a* which extends into a bore 18 at one side of the housing and has a lug 17*b* which prevents this end from being withdrawn from the bore but allows the pivotal movement of the retainer about the axis of the bore. The lug rises at a right angle to the bent end 17*a* of the rod whose rectilinear portion has been repeated at 17*c*.

At its opposite end, the rod 17*c* is formed with a stepped portion 17*d* having a finger 17*e* engaging beneath a ledge 19 formed on the casing and constituting locking means which retains the spring member in place over the clockwork. The straight portion thus terminates in two shanks which, in turn, terminate in the lock and finger, respectively, and which lie at right angles to the straight portion to receive the clockwork between. To release the clockwork, it is merely necessary to swing the straight portion 17*c* to the right or to the left and thereby engage it from the ledge 19, whereupon the straight portion can be raised and the clockwork extracted and replaced.

Figure 4:
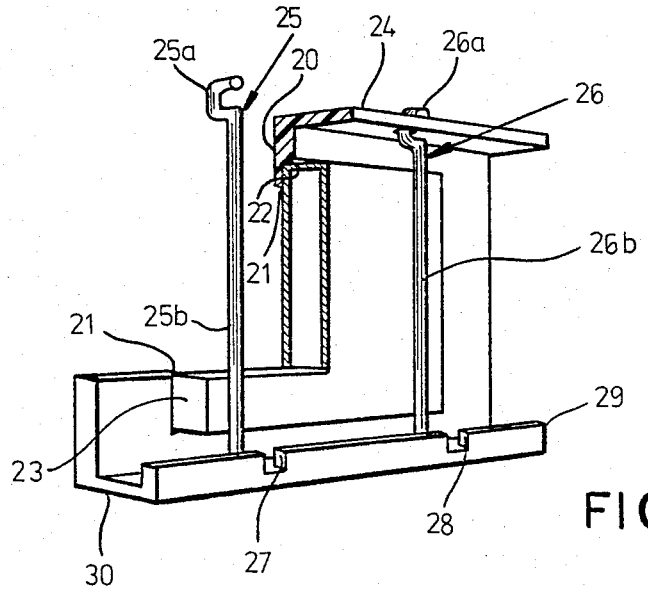
FIG. 4 is a similar view illustrating another embodiment of the invention wherein the casing is generally of "U" cross section as contrasted with the generally flat casing structure of FIG. 3.

When the casing has the "U"-section configuration shown for the casing 20 in FIG. 4, the resulting channel can have an opening formed in its web through which the clock face can project and which can be provided with a step 22 in the recess 21 receiving the clockwork 23.

In the side wall 24, a hook 25*a* or 26*a* of the retainers 25 and 26 can engage. These retainers have straight portions 25*b* and 26*b* whose free ends form fingers which can be inserted through slots 27 and 28 behind the ledge 29 of the opposite side 30. When these fingers are shifted say to the left as seen in FIG. 4, away from the slots, they are held against the underside of the ledge by the intrinsic resilience of the retaining elements which are braced against the clockwork 23.

The embodiment of FIG. 5 utilizes similar principles in that the box-like casing 31 is formed in an end wall with a cutout 32 having the step 33 receiving the clockwork 34. Proximal to the two ends of the side wall 35, openings 36 and 37 are provided. The ends of the retaining elements 38 and 39, bent so as to have locks of the type shown in FIG. 3, are engaged so as to permit slight lateral deflection of each of these members. The opposite ends of these members are straight and form fingers which can engage in "L"-shaped cutouts or slits 40 and 41 in the opposite side wall 42 and can engage below overhangs 40*a* and 41*a*, respectively, with slight resilient deformation of the members 38 and 39 which are braced against the clockwork 34. By simply shifting the fingers outwardly along the angular slots 40 and 41, these fingers can be withdrawn from the slots toward the viewer in FIG. 5 to release the clockwork.

I have referred throughout this application to a housing or casing as the element to which the clockwork is to be secured. While in most cases this element will be the struccture which also forms the exterior of the clock, in some cases the clockwork may be secured to another carrier which, in turn is mounted in another housing or casing structure. Thus, when reference is made herein to a "carrier", it should be understood that it is thereby intended to identify the independent carrier or the casing whichever may be the element to which the clockwork is physically secured.

I claim:

1. A clock having a clockwork carrier formed with an opening, a seat adjacent said opening and a pair of opposite walls flanking said opening, a clockwork received in said opening and braced against said seat, and a pair of generally parallel transversely spaced retaining spring rods having respective opposite ends engaged in said walls and spanned across a back of said clockwork and resiliently braced against said clockwork at least in part by a bend in at least one end of each rod.

2. The assembly defined in claim 1 wherein each of said bars is formed at one of said ends with a formation pivotally engaged in one of said walls of said carrier.

3. The assembly defined in claim 2 wherein the opposite end of said bar is provided with a formation engaging beneath an overhang formed on the said wall opposite said one of said walls of said carrier.

4. The assembly defined in claim 3 wherein said carrier is a flat plate and said seat is a projection formed on a face of said plate.

5. The assembly defined in claim 4 wherein said face of said plate is provided with a recess receiving said clockwork and preventing lateral displacement thereof.

6. The assembly defined in claim 3 wherein said overhang is formed by an angular slot in said opposite wall.

7. The assembly defined in claim 6 wherein said carrier is a box-like casing.

8. The assembly defined in claim 3 wherein said carrier is a "U"-shaped body and said opposite wall has an inwardly extending ledge forming said overhang, said ledge having a slot through which said opposite end of said bar can be inserted beneath said ledge.

9. The assembly defined in claim 7 wherein said casing is provided with a recess receiving said clockwork and preventing lateral displacement thereof.

10. The assembly defined in claim 8 wherein said "U"-shaped body has a web formed with a recess receiving said clockwork and preventing lateral displacement thereof.

* * * * *